US007211007B2

(12) United States Patent
Sullivan et al.

(10) Patent No.: US 7,211,007 B2
(45) Date of Patent: May 1, 2007

(54) GOLF BALL HAVING VISIBLE NON-SPHERICAL INSERT

(75) Inventors: Michael J. Sullivan, Barrington, RI (US); William B. Lacy, Plymouth, MA (US); Herbert C. Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 100 days.

(21) Appl. No.: 11/101,207

(22) Filed: Apr. 7, 2005

(65) Prior Publication Data

US 2005/0197211 A1 Sep. 8, 2005

Related U.S. Application Data

(60) Continuation-in-part of application No. 10/414,879, filed on Apr. 16, 2003, now Pat. No. 6,929,567, which is a division of application No. 09/821,641, filed on Mar. 29, 2001, now Pat. No. 6,595,874, which is a continuation-in-part of application No. 09/447,653, filed on Nov. 23, 1999, now Pat. No. 6,485,378.

(51) Int. Cl.
*A63B 37/06* (2006.01)

(52) U.S. Cl. ..... 473/374

(58) Field of Classification Search ..... 473/351, 473/353, 355, 377, 374
See application file for complete search history.

(56) References Cited

U.S. PATENT DOCUMENTS

| | | | |
|---|---|---|---|
| 697,925 | A | 4/1902 | Kempshall |
| 698,516 | A | 4/1902 | Kempshall |
| 700,658 | A | 5/1902 | Kempshall |
| 701,741 | A | 6/1902 | Kempshall |
| 704,748 | A | 7/1902 | Kempshall |
| 704,838 | A | 7/1902 | Kempshall |
| 711,508 | A | 10/1902 | Kempshall |
| 720,852 | A | 2/1903 | Smith, Jr. |
| 726,471 | A | 4/1903 | Smith, Jr. |
| 757,600 | A | 4/1904 | Crawford |
| 780,582 | A | 1/1905 | Richards |
| 790,252 | A | 5/1905 | Du Mahaut |
| 1,255,388 | A | 2/1918 | Cobb |
| 1,426,712 | A | 8/1922 | Chatfield |
| 1,482,232 | A | 1/1924 | Hazeltine |
| 1,524,171 | A | 1/1925 | Chatfield |
| 1,553,386 | A | 9/1925 | Kuhlke |
| 1,855,448 | A | 4/1932 | Hazeltine |
| 2,055,326 | A | 9/1936 | Young |
| 2,181,350 | A | 11/1939 | Smith |

(Continued)

FOREIGN PATENT DOCUMENTS

| | | |
|---|---|---|
| GB | 234713 | 6/1925 |

(Continued)

*Primary Examiner*—Raeann Trimiew
(74) *Attorney, Agent, or Firm*—William B. Lacy

(57) ABSTRACT

A golf ball comprising a pre-formed selectively-weighted inner core insert including a hub having a specific gravity of greater than 1.2 and a plurality of outer elements connected to the hub and having a specific gravity of less than 0.9; an outer core molded about the insert to form a sphere having an outer surface; and a cover disposed around the outer core, the cover having an outer dimpled surface; wherein the outer core and cover are optically transparent or translucent.

18 Claims, 5 Drawing Sheets

U.S. PATENT DOCUMENTS

| | | | | |
|---|---|---|---|---|
| 2,307,182 | A | | 1/1943 | Young |
| 2,364,955 | A | | 12/1944 | Diddel |
| 2,376,085 | A | | 5/1945 | Radford et al. |
| 3,228,686 | A | | 1/1966 | Faulkner, III |
| 3,256,019 | A | | 6/1966 | Barton |
| 3,738,655 | A | | 6/1973 | Feddick et al. |
| 4,173,345 | A | | 11/1979 | Pocklington |
| 4,203,941 | A | | 5/1980 | Brooker |
| 4,264,075 | A | | 4/1981 | Miller et al. |
| 4,625,964 | A | | 12/1986 | Yamada |
| 4,998,734 | A | * | 3/1991 | Meyer ..... 473/356 |
| D348,915 | S | | 7/1994 | Fraser |
| 5,480,143 | A | | 1/1996 | McMurry |
| 5,820,485 | A | | 10/1998 | Hwang et al. |
| 5,836,834 | A | | 11/1998 | Masutani et al. |
| 5,984,807 | A | | 11/1999 | Wai et al. |
| 6,042,487 | A | * | 3/2000 | Schrimmer et al. ..... 473/353 |
| 6,213,893 | B1 | | 4/2001 | Maruko et al. |
| 6,485,378 | B1 | | 11/2002 | Boehm |
| 6,595,874 | B2 | | 7/2003 | Sullivan et al. |
| 6,929,567 | B2 | * | 8/2005 | Sullivan et al. ..... 473/374 |
| 2004/0171437 | A1 | | 9/2004 | Sullivan et al. |
| 2004/0176186 | A1 | | 9/2004 | Sullivan et al. |
| 2004/0214661 | A1 | | 10/2004 | Sullivan et al. |

FOREIGN PATENT DOCUMENTS

| | | |
|---|---|---|
| GB | 1321270 | 6/1973 |
| GB | 2007581 | 5/1979 |
| GB | 2162072 | 1/1986 |
| JP | 9285565 | 11/1997 |

* cited by examiner

GOLF BALL HAVING VISIBLE NON-SPHERICAL INSERT

CROSS-REFERENCE TO RELATED APPLICATIONS

The present application is a continuation-in-part of U.S. application Ser. No. 10/414,879, filed Apr. 16, 2003 now U.S. Pat. No. 6,929,567, which is a divisional application of 09/821,641, filed Mar. 29, 2001, now U.S. Pat. No. 6,595,874, which is continuation-in-part of U.S. patent application Ser. No. 09/447,653 filed on Nov. 23, 1999, now U.S. Pat. No. 6,485,378, the disclosures of which are incorporated herein in their entirety.

FIELD OF THE INVENTION

This invention generally relates to golf balls and, more particularly, to a selectively-weighted golf ball having at least one optically transparent or translucent layer.

BACKGROUND OF THE INVENTION

Conventional golf balls have been designed to provide particular playing characteristics. These characteristics typically include initial velocity, compression, and spin of the golf ball, and can be optimized for various types of players. For example, certain players prefer a ball that has a high spin rate in order to control the flight of the ball and to stop the golf ball on the green. This type of ball, however, does not usually provide maximum distance. Other players prefer a ball that has a low spin rate and high resiliency to maximize distance.

Early solid golf balls were generally comprised of a hard core and a hard cover. Generally, if the golf ball has a soft core and a hard cover, it has a low spin rate. If the golf ball has a hard core and a hard cover, it exhibits very high resiliency for distance, but a "hard" feel and is difficult to control on the greens. Additionally, if the golf ball has a hard core and a soft cover, it will have a high rate of spin. More recently developed solid balls are comprised of a core, at least one intermediate layer, and a cover. The intermediate layers improve the playing characteristics of solid balls and can be composed of thermoset or thermoplastic materials.

Typically, solid golf ball cores are spherical and solid. In an effort to improve the spin rate of balls, the weight distribution in the golf ball has been varied by concentrating the weight either in the spherical inner cores or in the mantle(s) near the surface of the ball. It is desired, therefore, to provide a golf ball with symmetrical, non-spherical weight distribution that provides unique spin rate characteristics.

Several patents are directed to inner cores that have been modified with non-spherical features such as bores or projections.

U.S. Pat. No. 720,852 issued to Smith discloses an internal core with small, solid protuberances projecting therefrom. The core is encased in a rubber layer having small, solid protuberances projecting therefrom. A silk layer is wound thereto, and then the ball is encased in an outer covering. The non-spherical core protuberances anchor the rubber and silk layers and increase the resiliency of the ball as a whole, but have no weight distribution function.

U.S. Pat. No. 1,524,171 issued to Chatfield discloses a core with a hollow, spherical center that supports cylindrical, solid lugs. A spherical casing surrounds and abuts the tips of the lugs. The lugs and casing are designed so that the casing compresses the lugs in the finished ball. Fluid or wound rubber bands occupy the space around the lugs, between the spherical center and the casing. The non-spherical lugs promote the accurate location of the center by facilitating uniform and spherical winding of the rubber bands about the center, but have no weight distribution function. An outer shell surrounds the casing.

U.K. Patent Application No. 2,162,072 issued to Slater discloses a golf ball with a non-spherical inner core that includes solid, support members or struts that diverge from a common center. The struts form a generally cubic, tetrahedral, or octahedral shaped core. The struts locate the inner core symmetrically within a mold cavity but perform no weight distribution. An outer core is molded about the inner core, and a cover is molded thereon. The inner and outer cores are formed from identical or similar materials.

U.S. Pat. No. 5,480,143 issued to McMurry discloses a substantially spherical practice ball comprising mutually perpendicular members with a plurality of walls that interconnect the members. The walls increase the drag on the ball so that smaller playing fields can be used.

U.S. Pat. No. 5,836,834 issued to Masutani et al. discloses a two or three piece golf ball comprising a two-layer solid core composed of a low-hardness inner core and a high-hardness outer core joined around the low-hardness inner core. A projection is formed on the inner surface of the high-hardness outer core such that the projection extends along an approximate normal direction, while a depression corresponding to the projection is formed in the outer surface of the low-hardness inner core, and the low-hardness inner core and the high-hardness outer core are joined together such that the projection is inserted into the depression.

Other patents disclose adding perimeter weights to golf balls to increase the moment of inertia. U.S. Pat. No. 5,984,806 discloses a golf ball with visible perimeter weights disposed on a spherical inner cover.

However, these patents do not disclose a golf ball having the configuration as disclosed herein to provide the improved golf balls of the present invention.

SUMMARY OF THE INVENTION

The present invention is directed to a golf ball having

The present invention is also directed to a golf ball having

The present invention is further directed to a golf ball

BRIEF DESCRIPTION OF THE DRAWINGS

In the accompanying drawings, which form a part of the specification and are to be read in conjunction therewith and in which like reference numerals are used to indicate like parts in the various views:

FIGS. 12(*b*) and 12(*c*) are cross-sectional views of variations of the embodiment shown in FIG. 12(*a*).

DETAILED DESCRIPTION OF THE PREFERRED EMBODIMENTS

Figure 1:
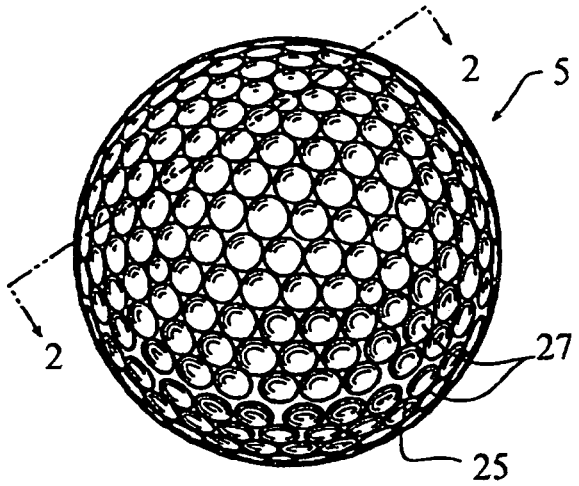
FIG. 1 is a side view of a golf ball according to the present invention.
Figure 2:
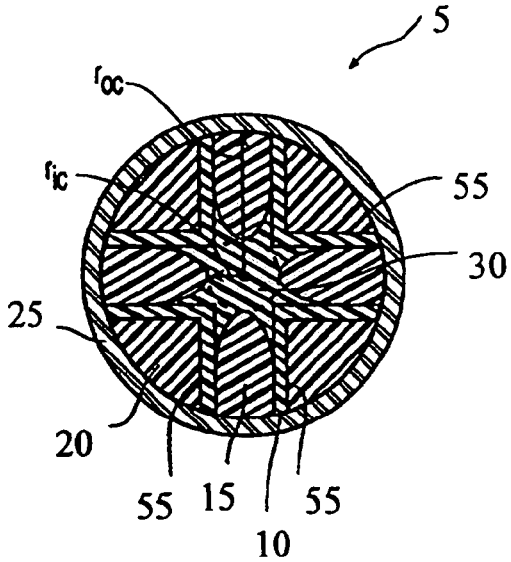
FIG. 2 is a cross-sectional view along the line 2—2 of FIG. 1 of the golf ball according to the present invention.
Figure 3:
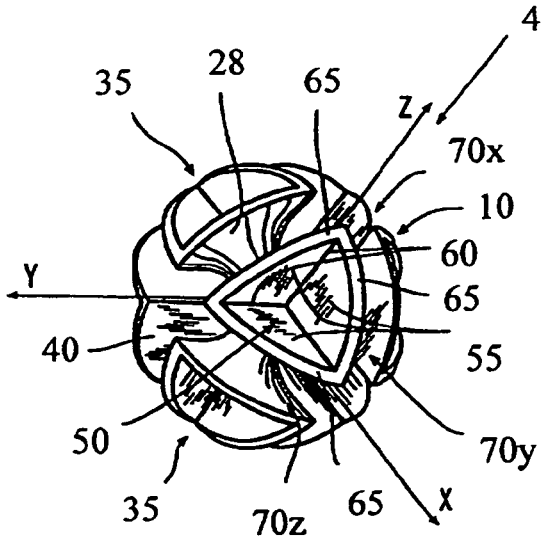
FIG. 3 is a side view of an inner core of the golf ball shown in FIG. 2.
Figure 4:
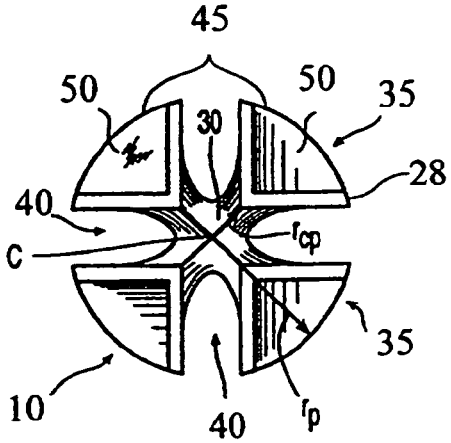
FIG. 4 is a plan view along the arrow 4 of FIG. 3 of the inner core according to the present invention.

Referring to FIG. 1, a golf ball 5 of the present invention is substantially spherical and has a cover 25 with a plurality of dimples 27 formed on the outer surface thereof. Referring to FIGS. 2–4, the golf ball 5 includes an inner core 10, an outer core 15 and 20, and the cover 25 (shown without dimples). The inner core 10 includes a three-dimensional outer surface 28, a center C, a central portion 30, and a plurality of projections 35. The central portion 30 and projections 35 are preferably integrally formed, so that the inner core is a unitary piece. Preferably, inner core 10 is a pre-formed insert that can be overmolded with other materials to form the core of the golf ball.

Referring to FIG. 4, the outer surface 28 of the inner core 10 is defined by the radial distances from the center C. At least two of the radial distances about the outer surface, $r_{cp}$ and $r_p$, are different. The central portion 30 of inner core 10 has a radius, designated by the arrow $r_{cp}$, that extends from the core center C to the outer surface of the central portion. The central portion 30 is solid in this embodiment but may be hollow, as discussed below.

Referring to FIGS. 3 and 4, each of the projections 35 extend radially outwardly from the central portion 30, and are spaced from one another to define gaps 40 there between. The projections 35 are shaped so that the inner core 10 is substantially symmetrical. Each projection 35 has an enlarged free end 45 and a substantially conical shape. Each free end 45 includes an open recess 50. Each projection has a radius, designated by the arrow $r_p$, that extends from the core center C to the outer surface 28 at the free end 45. The projection radii $r_p$ differ from the central portion radius $r_{cp}$.

Referring to FIG. 3, each recess 50 is formed by three integral side walls 55. Each of the side walls 55 is shaped like a flat quarter circle. The quarter circle includes two straight edges 60 joined by a curved edge 65. In each projection 35, each of the side walls 55 is joined at the straight edges 60. The curved edges 65 of each of the projections allow the inner core to have a spherical outline.

With reference to a three-dimensional Cartesian Coordinate system, there are perpendicular x, y, and z axii, respectively that form eight octants. There are eight projections 35 with one in each octant of the coordinate system, so that each of the projections 35 forms an octant of the skeletal sphere. Thus, the inner core is symmetrical. The gaps 40 define three perpendicular concentric rings $\mathbf{70}_x$, $\mathbf{70}_y$, and $\mathbf{70}_z$. The subscript for the reference number 70 designates the central axis of the ring about which the ring circumscribes.

Turning to FIGS. 2 and 4, the outer core includes a first section 15 and a second section 20. The first section 15 fills the gaps 40 around the projections 35, and is disposed between the side walls 55 of adjacent projections 35. It is preferred that the diameter of the core which includes the inner core and the outer core is between about 1.00 inches and about 1.64 inches for a ball having a diameter of 1.68 inches.

The second section 20 fills the recesses 50 of each projection 35, and is disposed between the side walls 55 of a single projection 35. The outer core is formed so that the outer core terminates flush with the free end 45 of each projection 35. The outer core has a substantially spherical outer surface. The cover 25 is formed about the inner core 10 and the outer core sections 15 and 20, so that both the inner and outer cores abut the cover.

Referring to FIG. 2, the formation of a golf ball starts with forming the inner core 10. As discussed above, inner core 10 is preferably pre-formed as an insert. The inner core 10, outer core sections 15 and 20, and the cover 25 can be formed by compression molding, by injection molding, or by casting. These methods of forming cores and covers of this type are well known in the art.

The inner and outer core materials preferably have substantially different material properties so that there is a predetermined relationship between the inner and outer core materials, to achieve the desired playing characteristics of the ball such as the spin rate of the ball. For instance, inner core 10 may be constructed from a low specific gravity material having a specific gravity of less than 0.9 or preferably less than 0.8. Outer core section 20, on the other hand, is preferably made from a high specific gravity material having a specific gravity of greater than 1.2, more preferably greater than 1.5 and most preferably greater than 1.8. Since outer core section 20 is denser and located more radially outward relative to inner core 10, ball 5 has a high moment of inertia and a low spin rate.

Figure 6:
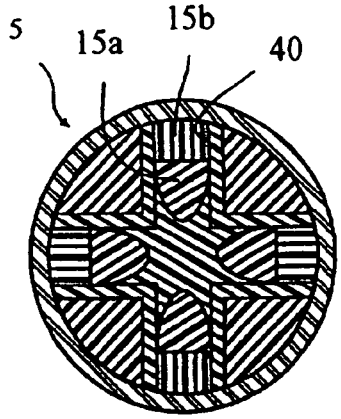

Outer core section 15 can be made from a material having a low specific gravity similar to the inner core 10. In this instance, outer core 20 has the highest specific gravity and contributes most to the ball's high moment of inertia. On the other hand, outer core section 15 may have the same specific gravity as outer core 20, so long as the total weight of the ball does not exceed the USGA legal weight of 1.62 ounces. Alternatively, as shown in FIG. 6, outer core section 15 can be divided into two zones 15*a* and 15*b*. Preferably, zone 15*b* has a high specific gravity of more than 1.2, more preferably more than 1.5, and most preferably more than 1.8. Zone 15*b* may have specific gravity similar to that of inner core 10. Similarly, outer core section 20 may also have a high specific gravity zone and a low specific gravity zone. Alternatively, projections 35 of inner core 10 may be made with a high specific gravity material while the rest of inner core 10 is made with a low specific gravity material to provide the ball with a high moment of inertia.

Figure 7:
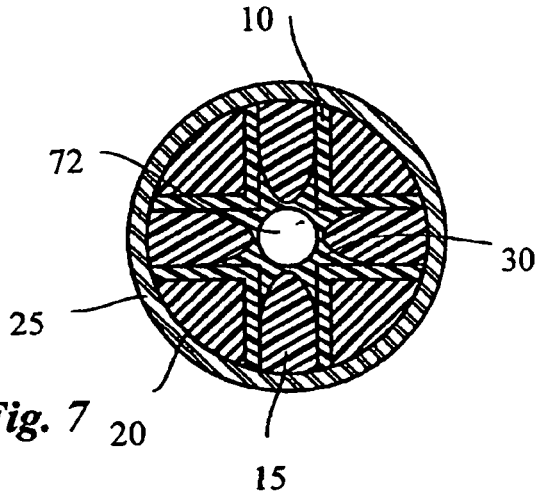

To further distribute the weight toward the outer core, inner core 10 may include hollow cavity 72, as shown in FIG. 7. Cavity 72 of inner core 10 may be filled with a low specific gravity liquid, such as mineral or lubricating oils, vegetable oil, methanol, ethanol, ammonia, etc., so long as the selected liquid does not react with the surrounding materials.

Figure 8:
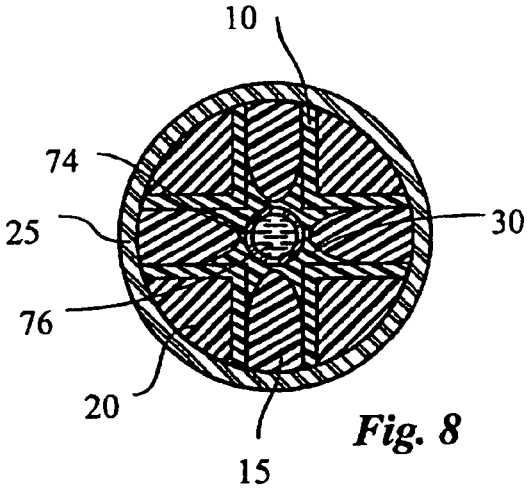

On the other hand, to make a low moment of inertia or high spin rate ball, central portion 30 of inner core 10 may be constructed from a high specific gravity material, while projections 35, outer core portion 15 or core portion 20, or any combination of these three elements can be made from a low specific gravity material. Preferably, central portion 30 has a specific gravity of greater than 1.2, more preferably greater than 1.5 and most preferably greater than 1.8. Preferably, the low specific gravity material has a specific gravity of less than 0.9 and more preferably less than 0.8. Center portion 30 can also be filled preferably with a non-reactive high specific gravity liquid such as glycerin or carbon tetrachloride. As shown in FIG. 8, cavity 72 of center position 30 has an envelope 74 encasing a fluid 76. Advantageously, envelope 74 can be made from a material capable of containing and isolating a reactive liquid such that such liquid can be used.

Suitable fluids usable in accordance with their specific gravities include air, aqueous solutions, liquids, gels, foams, hot-melts, other fluid materials and combinations thereof. Examples of suitable liquids include either solutions such as salt in water, corn syrup, salt in water and corn syrup, glycol and water or oils. The liquid can further include pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthenic oil. Examples of suitable melts include waxes and hot melts. Hot-melts are materials, which at or about normal room temperatures are solid but at elevated temperatures become liquid. A high melting temperature is desirable since the liquid core is heated to high temperatures during the molding of the inner core, outer core, and the cover. Alternatively, the liquid can be a selective reactive liquid system, which combines to form a solid. Examples of suitable reactive liquids are silicate gels, agar gels, peroxide cured polyester resins, two part epoxy resin systems, peroxide cured liquid polybutadiene rubber compositions, reactive polyurethanes, silicones and polyesters.

Suitable inner and outer core materials include thermosets, such as rubber, polybutadiene, polyisoprene; thermoplastics such as ionomer resins, polyamides or polyesters; or a thermoplastic elastomer. Suitable thermoplastic elastomers include PEBAX®, HYTREL®, thermoplastic urethane, and KRATON®, which are commercially available from Elf-Atochem, DuPont, and Shell. The inner and outer core materials can also be formed from a castable material. Suitable castable materials include urethane, polyurea, epoxy, and silicone. Additionally, other suitable core and cover materials are disclosed in U.S. Pat. No. 5,919,100, which is incorporated in its entirety herein by reference.

More specifically, the low specific gravity materials can be manufactured from a plastic polymer embedded with a density reducing filler such as hollow spheres or microspheres or is otherwise reduced in density, e.g., with foam. Additionally, suitable materials include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having reduced specific gravity. The materials are referred to as reaction injection molded materials. On the other hand, the high specific gravity layer may be made from a high density metal or from high density metal powder encased in a polymeric binder. High density metals such as steel, tungsten, lead, grass, bronze, copper, nickel, molybdenum or their alloys.

Figure 5:
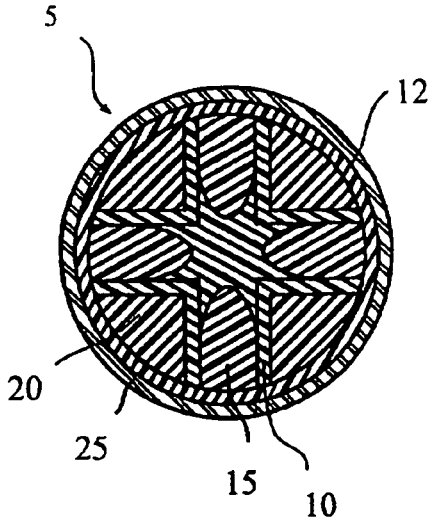
FIGS. 5–8 are cross-sectional views of the variations of the embodiment shown in FIGS. 2–4.

The cover 25 should be tough, cut-resistant, and selected from conventional materials used as golf ball covers based on the desired performance characteristics. The cover may be comprised of one or more layers, such as the ball shown in FIG. 5. Cover materials such as ionomer resins, blends of ionomer resins, thermoplastic or thermoset urethane, and balata, can be used as known in the art.

In accordance to another aspect of the invention, inner core 10 itself is a pre-formed selectively weighted structure. Preferably, the pre-formed selective weighted structure is a solid unitary element for the ease of manufacture. However, the present invention is not so limited. For example, as described above the projections 35 can be made from a different material than core 30 to achieve a desired weight distribution. The selectively weighted structure may be overmolded in any suitable fashion with outer core materials to form the core of golf ball 5. Injection molding, compression molding, reaction injection molding and casting are some of the preferred manufacturing methods. The pre-formed inserts in accordance to the present invention can focus or concentrate the weight of the ball either at the center of the ball, or at discrete locations proximate the ball's outer surface. These discrete locations are positioned symmetrically relative to the ball's outer surface so as not to affect the aerodynamic and rolling characteristics of the ball. The core or other mantle layers can be molded around the pre-formed insert such that they either fully enclose the pre-formed insert, or enclose most of the insert with the possibility of leaving some portions exposed or visible on the finished surface of the ball by leaving these portions flush with the surface.

Figure 9:
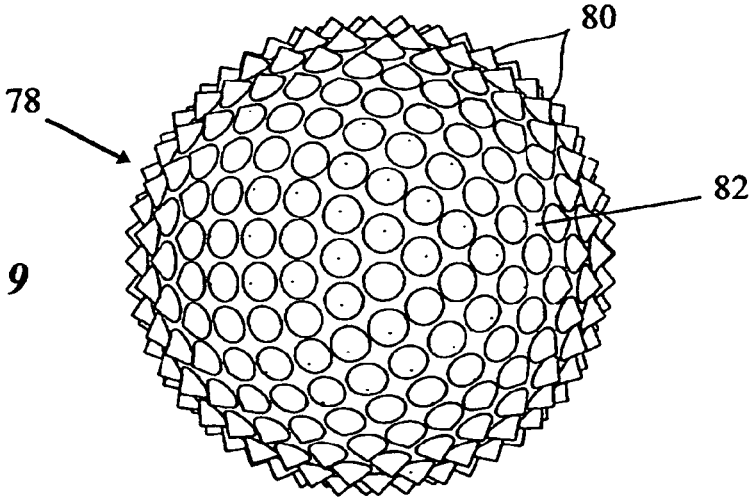
FIG. 9 is a side view of another embodiment of the inner core in accordance to the present invention.

Referring to FIG. 9, another embodiment of an inner core is shown. The inner core 78 includes a spherical central portion and a plurality of projections 80 extending radially outwardly from the central portion. The projections 80 include a base and a pointed free end. The projections 80 are preferably conical and taper from the base to the pointed free end. The projections 80 can have other shapes, such as polygons. Examples of polygonal shapes are triangles, pentagons, and hexagons.

Inner core 78 is an example of a pre-formed insert of the present invention, which provides a high moment of inertia and low spin rate ball. Preferably, projections 80 upstanding from surface 82 are made from a high specific gravity material, as discussed above, and the interior of core 78 is hollow or filled with a low density material or liquid. More preferably, the spherical surface 82 of core 78 is made from the same material as the projections 80. In this embodiment, the spherical surface 82 and the projections 80 are located proximate to the surface of the ball to maximize the ball's moment of inertia.

Figure 10:
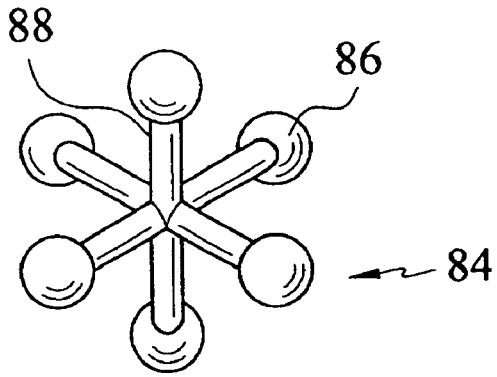
FIGS. 10(*a*)–10(*d*) are side views of other embodiments of the inner core in accordance to the present invention.
Figure 10:
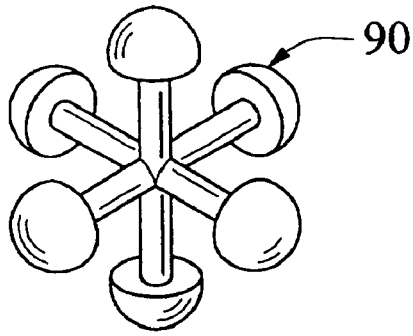
Figure 10:
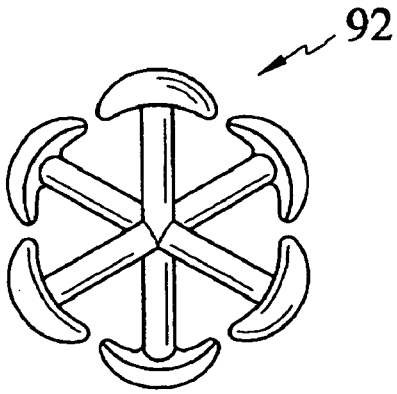
Figure 10:
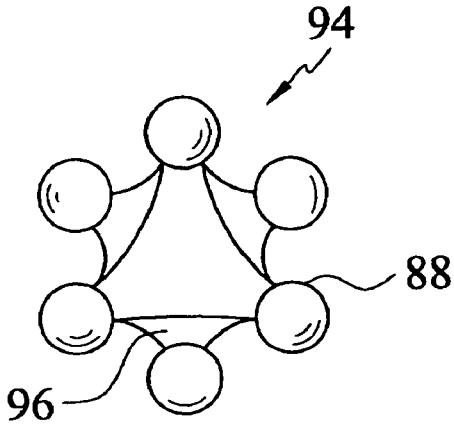

FIGS. 10(*a*), 10(*b*), 10(*c*), and 10(*d*) illustrate other embodiments of the pre-formed insert in accordance to the present invention that provide a high moment of inertia ball. A ball-and-rod insert 84 is shown in FIG. 10(*a*). Preferably, the insert 84 is made from a high density material. Since balls 86 are significantly larger than rods 88, and are located radially further away from the center of the golf ball than rods 88, balls 86 impart a higher moment of inertia to the golf ball. Advantageously, since balls 86 and rods 88 are preferably made from the same material the manufacturing process is simplified. To further maximize the moment of inertia, rods 88 may be hollow. Alternatively, hollow rods 88 may be filled with a low specific gravity fluid, or rods 88 can be made from a low specific gravity material or are filled with a low density filler.

Similarly, balls 88 can be enlarged to further maximize the moment of inertia, such that the ball-and-rod configuration becomes a mushroom configuration as shown in FIG. 10(*b*) or an anchor configuration as shown in FIG. 10(*c*). The above discussion relating to the ball-and-rod insert 84 also applies to the mushroom insert 90 and anchor insert 92. FIG. 10(*d*) illustrates another variation of the ball-and-rod configuration. The webbed ball-and-rod pre-formed insert 94 comprises a plurality of balls 88 connected together by webbed legs 96. Advantageously, the weights from the balls 88 and webbed legs 96 are disposed toward the outer perimeter of the golf ball to maximize the moment of inertia.

The balls 88 of insert 94 may also be enlarged to have a mushroom shape or an anchor shape.

Figure 11:
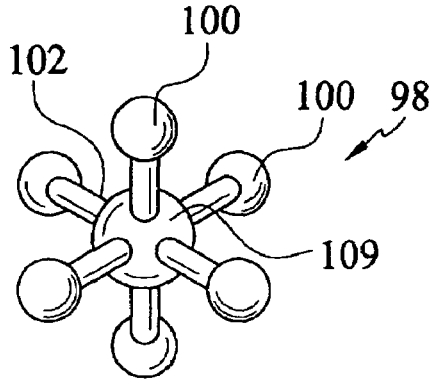
FIGS. 11(*a*)–11(*e*) are side views of other embodiments of the inner core in accordance to the present invention.
Figure 11:
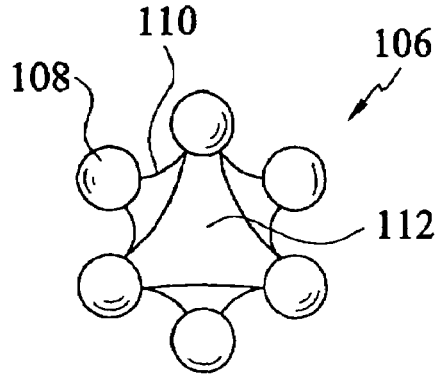
Figure 11:
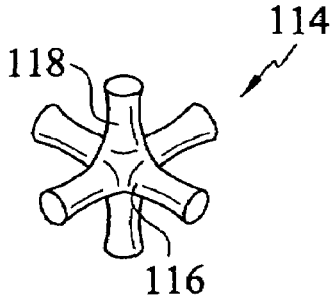
Figure 11:
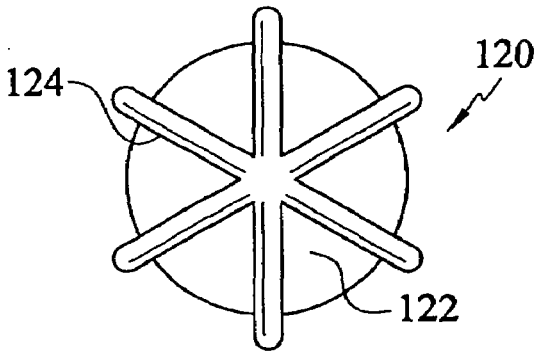
Figure 11:
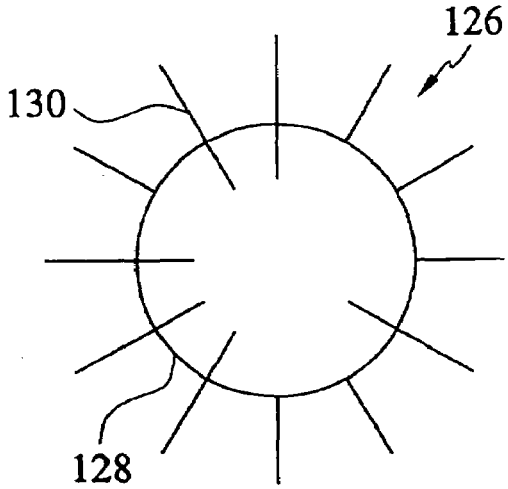

FIGS. 11(*a*), 11(*b*), 11(*c*), 11(*d*) and 11(*e*) illustrate low moment of inertia embodiments of the pre-formed insert inner core in accordance to the present invention. FIG. 11(*a*) is substantially similar to the ball-and-rod insert shown in FIG. 10(*a*). Preformed insert 98 comprises a plurality of low specific gravity balls 100 connected by rods 102 to high specific gravity hub 104. Hub 104 preferably has a specific gravity much higher than that of balls 100. Suitable high and low specific gravity materials are discussed above. Preferably, rods 102 are also made from low specific gravity material. Alternatively, either balls 100 or rods 102, or both, may be hollow. Also, insert 98 may have a mushroom or anchor configuration. High gravity insert 106, shown in FIG. 11(*b*), is substantially similar to insert 94 shown in FIG. 10(*d*), except that balls 108 are made from a low specific gravity material. Balls 108 and webbed legs 110 define a center 112. Center 112 is adapted to receive a high specific gravity element such as a metal ball bearing or other heavy objects. Alternatively, center 112 may be filled with a high specific gravity moldable material. Balls 108 may also be hollow. Webbed legs 110 preferably center and hold the ball bearing in place during the molding process. Alternatively, insert 106 may also have a mushroom or anchor configuration.

FIG. 11(*c*) illustrates a hub-and-rod insert 114, which is similar to the insert 98 of FIG. 11(*a*), except that insert 114 has hub 116 and rods 118, but does not have the low specific gravity balls disposed at the end of rods 118. Insert 114 is preferably made from a high specific gravity material discussed above.

FIG. 11(*d*) shows insert 120, which comprises a high specific gravity center 122 surrounded by a plurality of rings 124. Rings 124 help to position and center insert 120 in the mold cavity. Similarly, insert 126, shown in FIG. 11(*e*), has high density hub 128 surrounded by a plurality of radially extending centering pins 130.

Figure 12:
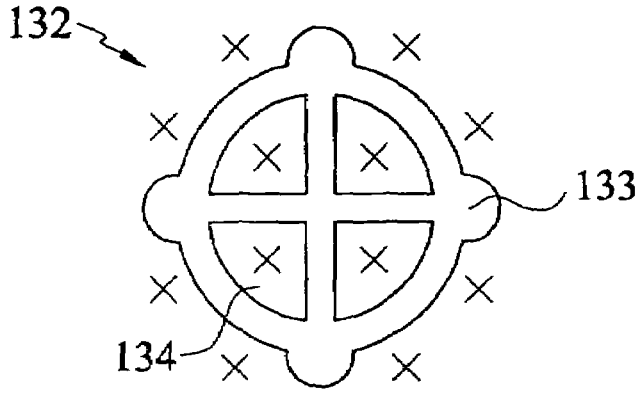
FIG. 12(*a*) is a side view of another embodiment of the inner core in accordance to the present invention.
Figure 12:
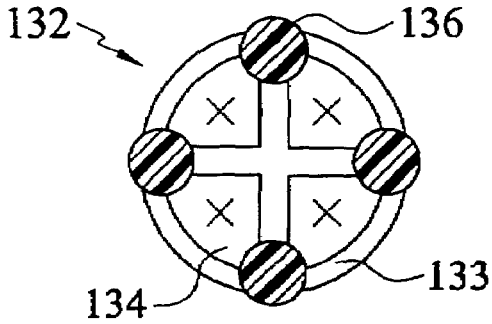
Figure 12:
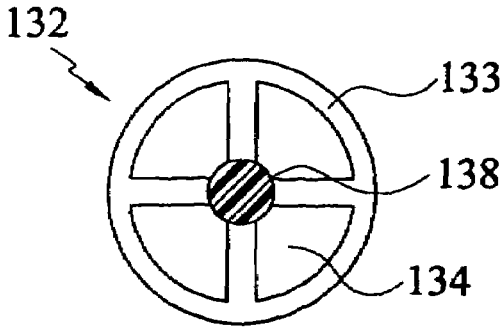

In accordance to yet another aspect of the invention, FIG. 12(*a*), 12(*b*) and 12(*c*) illustrate other embodiments of the pre-formed insert as a continuous configuration having chambers that may be solid, hollow, or partially filled. As shown in FIG. 12(*a*), insert 132 comprises a shell 133 with openings 134 on its surface. Core materials can be molded around the open shell 133 and penetrate its interior through openings 134. Insert 132 may be made from a low specific gravity material or be hollow, and the core material can be a high specific gravity material to provide a low moment of inertia ball. On the other hand, insert 132 can be made from a high specific gravity material and the core material can be a low specific gravity material to provide a high moment of inertia ball. Alternatively, insert 132, shown in FIG. 12(*b*), may have chambers 136 filled or partially filled with high specific gravity material to produce a perimeter weighted ball. On the other hand, insert 132, shown in FIG. 12(*c*), may have a dense hub 138 centrally located in open shell 133. Hub 138 can be made from a high specific gravity material such as a metal ball bearing, and shell 133 can be made from a low specific gravity material or be hollow. Preferably, shell 133 is sized and dimensioned such that it is located proximate to cover 25 of the golf ball 5.

Furthermore, the location of the balls 86, 100, 108, the mushroom and anchor heads, and chambers 136, as well as hubs 104, 116, 122, 128 and 138, and center 112 shown in FIGS. 10(*a*)–12(*c*) can be maximized if these structures are positioned relative to the centroid radius of the ball. The centroid radius is the radial distance from the center of the ball, where the moment of inertia switches from being increased and to being decreased as a result of the redistribution of weight when compared to the moment of inertia for a ball with no weight reallocation. In other words, when more of the ball's mass or weight is reallocated to the volume of the ball from the center to the centroid radius, the moment of inertia is decreased, thereby producing a high spin ball. When more of the ball's mass or weight is reallocated to the volume between the centroid radius and the outer cover, the moment of inertia is increased thereby producing a low spin ball. The centroid radius is discussed in detail in co-pending U.S. application Ser. No. 09/815,753, which is incorporated, in its entirety, herein by reference.

Hence, it is advantageous to locate balls 86, 100, 108, the mushroom and anchor heads, and chambers 136 between the cover of the ball and the centroid radius, and to locate hubs 104, 116, 122, 128 and 138, and center 112 between the center of the ball and the centroid radius.

Furthermore, although only six balls 86, 100, 108, six mushroom and anchor heads, and four chambers 136 are illustrated in the drawings, the pre-formed insert 10 may have any number of balls, mushroom and anchor heads, and chambers, as long as they are symmetrically located on the golf ball.

A preferred embodiment includes a clear outer cover layer, one as close to optically transparent as possible, but in other embodiments a merely translucent layer or a transparent layer that is colored or includes blended particulates may also be suitable. Another preferred embodiment includes a clear core layer surrounding a colored non-spherical insert, preferably a selectively-weighted component, also covered by a clear (transparent) or translucent outer cover layer. In this embodiment, the clear core layer may or may not have a homogenous thickness. Additionally, the non-spherical insert may extend through the clear core layer and/or cover layers, reaching the dimpled surface of the golf ball.

The cover typically has a thickness to provide sufficient strength, good performance characteristics, and durability. In one embodiment, the cover thickness is from about 0.02 inches to about 0.35 inches. The cover preferably has a thickness of about 0.02 inches to about 0.12 inches, preferably about 0.1 inches or less, more preferably about 0.07 inches or less. In one embodiment, the outer cover has a thickness from about 0.02 inches to about 0.07 inches. In another embodiment, the cover thickness is about 0.05 inches or less, preferably from about 0.02 inches to about 0.05 inches. In yet another embodiment, the outer cover layer thickness is between about 0.02 inches and about 0.045 inches, preferably between about 0.025 to about 0.04 inches. The core layer thickness can be any thickness, varying or otherwise, sufficient to form a spherical core of between about 0.75 inches and 1.58 inches, preferably between about 1.4 and 1.55 inches.

The clear cover and/or core layers can include any materials known to those of ordinary skill in the art including thermoplastic and thermosetting materials. For example, the cover layer may be formed from any of the polyurea, polyurethane, ionomer, and polybutadiene materials discussed herein. However, certain thermoplastic materials are also suitable. The core and/or cover layers may also likewise include one or more homopolymeric or copolymeric materials, such as: (1) Vinyl resins, such as those formed by the polymerization of vinyl chloride, or by the copolymerization of vinyl chloride with vinyl acetate, acrylic esters, or vinylidene chloride; (2) Polyolefins, such as polyethylene, polypropylene, polybutylene, and copolymers such as ethylene methylacrylate, ethylene ethylacrylate, ethylene vinyl acetate, ethylene methacrylic or ethylene acrylic acid, propylene acrylic acid, and copolymers and homopolymers produced using a single-site catalyst or a metallocene catalyst; (3) Polyurethanes, such as those disclosed in U.S. Pat. No. 5,334,673; (4) Polyureas, such as those disclosed in U.S. Pat. No. 5,484,870; (5) Polyamides, such as those prepared from diamines and dibasic acids, as well as those from amino acids; (6) Acrylic resins; (7) Thermoplastics; olefinic thermoplastic rubbers; block copolymers of styrene and butadiene, isoprene, or ethylene-butylene rubber; or copoly (ether-amide); (8) Polyphenylene oxide resins or blends of polyphenylene oxide with high impact polystyrenes; (9) Thermoplastic polyesters, such as polyethylene terephthalate, polybutylene terephthalate, and polyethylene terephthalate/glycol modified; (10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and (11) Blends of thermoplastic rubbers with polyethylene, propylene, polyacetal, nylon, polyesters, cellulose esters, and the like.

As briefly mentioned above, the core and/or cover layers may include ionomeric materials, such as ionic copolymers of ethylene and an unsaturated monocarboxylic acid, which are available under the trademark SURLYN® from DuPont, or IOTEK® and ESCOR® from Exxon. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The core and/or cover layers may also include at least one ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. In another embodiment, the acrylic or methacrylic acid is present in about 8 to 35 weight percent, more preferably 8 to 25 weight percent, and most preferably 8 to 20 weight percent.

In one embodiment, the core and/or cover layers include a low acid ionomer where the acid is present in about 10 to 15 weight percent and may include a softening co-monomer, e.g., iso—or n-butylacrylate, to produce a softer terpolymer. Suitable softening co-monomers include vinyl esters of aliphatic carboxylic acids, where the acids have 2 to 10 carbon atoms; vinyl ethers, where the alkyl groups contains 1 to 10 carbon atoms; and alkyl acrylates or methacrylates, where the alkyl group contains 1 to 10 carbon atoms. Preferred softening co-monomers include vinyl acetate, methyl acrylate, methyl methacrylate, ethyl acrylate, ethyl methacrylate, butyl acrylate, butyl methacrylate, and the like.

In another embodiment, the core and/or cover layers include at least one high acid ionomer. In this embodiment, the acrylic or methacrylic acid is present in at least about 16 percent by weight of a carboxylic acid, preferably from about 17 percent to about 25 percent by weight of a carboxylic acid, more preferably about 18.5 percent to about 21.5 percent by weight of a carboxylic acid. In some circumstances, an additional co-monomer can also be included. Suitable co-monomers are presented above.

In one embodiment, the clear core and/or cover layers may be formed from at least one polymer containing α,β-unsaturated carboxylic acid groups, or the salts thereof, that have been 100 percent neutralized by organic fatty acids, salts thereof, and enough ccation source to fully-neutralize all acid present. The organic acids are aliphatic, monofunctional (saturated, unsaturated, or multi-unsaturated) organic acids. Salts of these organic acids may also be employed. The salts of organic acids of the present invention include a metal, such as barium, lithium, sodium, zinc, bismuth, chromium, cobalt, copper, potassium, strontium, titanium, tungsten, magnesium, cesium, iron, nickel, silver, aluminum, tin, or calcium; and a salt of a fatty acid, such as stearic, behenic, erucic, oleic, or linoelic acids, or dimerized derivatives thereof.

The acid moieties of these highly-neutralized polymers ("HNP"), typically ethylene-based ionomers, are preferably neutralized greater than about 70 percent, more preferably greater than about 90 percent, and most preferably 100 percent. The HNP's may be also be blended with a second polymer component, which, if containing an acid group, may be neutralized in a conventional manner, by organic fatty acids, or both. The second polymer component, which may be partially- or fully-neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like.

In this HNP embodiment, the acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer. Preferred HNP materials are disclosed in U.S. Patent Application Publication Nos. 2004-0214661, 2004-0176186, and 2004-0171437, which are incorporated herein, in their entirety, by reference.

The use of a lightly colored or tinted outer layer makes possible color depth characteristics not previously possible. Similarly, the selectively-weighted components described above and any cover/core layers may contain reflective or optically active particulates, such as those described by Murphy in U.S. Pat. No. 5,427,378, which is incorporated by reference herein. In particular, these materials could be used in the selectively-weighted components of the present invention and covered with a clear outer layer. Pearlescent pigments, such as those sold by the Mearle Corporaton, may also be used in this way or may be added to the substantially clear core and cover layers.

If employed, it is preferable that the reflective material comprise at least one of metal flakes, iridescent glitters, metallized films, and colored polyester foils. The reflective particles preferably have faces that have an individual reflectance of over 75%, more preferably at least 95%, and most preferably 99–100%. For example, flat particles with two opposite faces can be used.

The maximum particle size of the reflective particles should be smaller than the thickness of the cover, and preferably is very small. The particle size preferably is 0.1 mm–1.0 mm more preferably 0.2 mm–0.8 mm, and most preferably 0.25 mm–0.5 mm. The quantity of reflective particles may vary widely, as it will depend upon the desired effect and is best determined experimentally. In general, an aesthetically pleasing reflective appearance can be obtained by using about 0.1–10, or more preferably 1–4 parts by weight reflective particles in the material.

One of the advantages of the at least partially translucent layers of the present invention are that smaller amounts of dye, pigment, optical brightener and/or metal flake are needed than would be required if the covers were made of an opaque material. If an opaque cover were formed, it would be necessary to have complete color coverage on the outer surface of the cover. However, in accordance with the present invention, pigments, dyes, and reflective particles that are well beneath the outer surface, such as those in the selectively-weighted components, contribute to the visibility of the ball.

Golf balls with clear (or, optionally, translucent) cover and core layers also have a unique appearance. For example, considering a clear dimpled outer cover layer, because the cover thickness at edge of the dimples is larger than the thickness of the cover at the base of the dimples, a "shadow" effect is portrayed on any opaque surface below the clear cover, such as a selectively-weighted component. The thicker the clear cover, the more pronounced the effect. A preferred embodiment of the present invention has a thinner cover with a lesser effect. In this embodiment, the outer clear cover will have a thickness of less than about 0.050 inches, more preferably less than about 0.040 inches.

Also, higher dimple surface coverage creates a more appealing look. The examples described herein have dimple surface coverage in excess of 80% of the surface of the ball. With high surface coverage and a thin cover, the edges of the dimple "shadows" merge to give the illusion that they are the surface of the ball. With sufficient dimple coverage, the dimple shadows take on a hexagonal appearance. This is most apparent in the optic yellow urethane and urea examples or in covers dyed with blue optical brightener.

Optical brighteners absorb the invisible ultra-violet portion of the daylight spectrum and convert this energy into the longer-wavelength visible portion of the spectrum. Suitable optical brighteners include stilbene derivatives, styryl derivatives of benzene and biphenyl, bis(benzazol-2-yl) derivatives, coumarins, carbostyrils, naphthalimides, derivatives of dibenzothiophene-5,5-dioxide, pyrene derivatives, and pyridotriazoles. In accordance with the present invention, any of these or other known optical brighteners including derivatives of 4,4'-diamino stilbene-2,2'-disulfonic acid, 4-mthyl-7-diethylamino coumarin and 2,5-bis(5-tert-butyl)-2-benzoxazolyl)thiophene may be used.

The amount of optically active materials to be included in the golf ball cover layer is largely a matter of choice. The amount can range anywhere from the minimum 0.03% level to 20% or more by weight of the resin solids in the clear coat. We have found an amount of about 0.3 to 7% by weight to be a very desirable amount and most prefer an amount of about 0.7% to 6%. However, the brightness can be made even a little greater by adding a greater amount of optically active material.

Fluorescent materials useful in the present invention are commercially-available fluorescent pigments and dyes, a few suitable ones are described in U.S. Pat. Ser. No. 2,809,954, 2,938,873, 2,851,424 or 3,412,036, which are incorporated by reference herein. A good commercial source for these products is DayGlo Color Corporation. As described in the cited patents, these fluorescent materials are organic co-condensates. They are typically composed of melamine, an aldehyde such as formaldehyde, a heterocyclic compound, and/or an aromatic sulfonamide. Typical of such materials is Solvent Yellow 44, compounds which are sold by DayGlo under the trademark Saturn Yellow® and by Lawter under the trademark Lemon Yellow®. The amount of fluorescent material to be used is largely a matter of choice depending on the brightness desired. However, it is preferred that the amount of fluorescent dye be from about 0.01% to about 0.5% by weight of the cover composition and the amount of fluorescent pigment be from about 0.5% to about 6% by weight of the cover composition.

In general, fluorescent dyes useful in the present invention include dyes from the thioxanthene, xanthene, perylene, perylene imide, coumarin, thioindigoid, naphthalimide and methine dye classes. Useful dye classes have been more completely described in U.S. Pat. No. 5,674,622, which is incorporated herein by reference in its entirety. Representative yellow fluorescent dye examples include, but are not limited to, Lumogen F Orange® 240 (BASF, Rensselaer, N.Y.); Lumogen F Yellow® 083 (BASF, Rensselaer, N.Y.); Hostasol Yellow® 3G (Hoechst-Celanese, Somerville, N.J.); Oraset Yellow® 8GF (Ciba-Geigy, Hawthorne, N.Y.); Fluorol 088® (BASF, Rensselaer, N.Y.); Thermoplast F Yellow® 084 (BASF, Rensselaer, N.Y.); Golden Yellow® D-304 (DayGlo, Cleveland, Ohio); Mohawk Yellow® D-299 (DayGlo, Cleveland, Ohio); Potomac Yellow® D-838 (DayGlo, Cleveland, Ohio) and Polyfast Brilliant Red® SB (Keystone, Chicago, Ill.).

A single fluorescent dye may be used to color an article of the invention or a combination of one or more fluorescent dyes and/or or optical brighteners and one or more conventional colorants may be used.

Because of the relatively unstable nature of optically active pigments and dyes, and especially because of the outside use to which golf balls are put, it is preferred that a UV stabilizer be added to the urethane and urea cover compositions. If either the optically active material or the cover material comes with sufficient UV stabilizer, it is obviously not beneficial to add more. However, UV absorbers are preferably present in the amount of from about 0.1% to about 3.0% by weight of the cover, and more preferably from about 0.5% to about 2.0%.

In another embodiment of the present invention, a conventional dye instead of a fluorescent dye can be used. Examples of non-fluorescent dye classes that can be used in the present invention include azo, heterocyclic azo, anthraquinone, benzodifuranone, polycyclic aromatic carbonyl, indigoid, polymethine, styryl, di- and tri-aryl carbonium, phthalocyanines, quinopphthalones, sulfur, nitro and nitroso, stilbene, and formazan dyes. The concentration of dye needed is specific to each application. However, typically between about 0.01 and 1 weight percent of regular dye based on total composition cover material is preferable. It will be understood that articles with dye loadings outside this range can be used in accordance with this invention.

In one preferred embodiment, to maintain color of the fluorescent cover, an ultraviolet overlay layer or coating which effectively filters radiation below 380 nm is use. Hindered amine light stabilizers can also be added to polycarbonate type matrixes to enhance the durability of fluorescent dyes contained therein.

It should be understood that the clear or translucent layer of the invention retain their optical properties despite their inclusion of a dye or filler particle. As used herein, the term transparent is defined as "capable of transmitting light so that objects or images can be seen as if there were no intervening material." As used herein, the term translucent is defined as "transmitting light but causing sufficient diffusion to prevent perception of distinct images."

The refractive indices of the clear polymer layers of the invention can provide unique optical properties to the effects the clear layer has on the viewing golfer. Refractive index n is typically given by the definition n=c/v, where c is the velocity of light in vacuum and v is the velocity of light in the medium that it is traveling in. The mean refractive index $n_d$ of the lenses is the index intended for light of wavelength 589 nm (if no other wavelength is given)—effectively, the slower the light travels in the medium, the higher the refractive index, and the more the light will refract.

While the refractive indices of the majority of optically-clear polymers is in the range of 1.45–1.6, in one preferred embodiment, the refractive index of the clear polymer layer is greater than 1.55, preferably between about 1.55 and about 1.9, more preferably between about 1.6 and 1.8, most preferably between about 1.6 and 1.7. If two adjacent layers are clear, such as the core layer and the cover layer, in one embodiment, the refractive indices of the two layers are within 0.05 of each other, and are preferably substantially the same. It should be understood that the closer in value the refractive indices are, the more efficient the light transmission, i.e., the color or fluorescent emission of the selectively-weighted inner core component. In another alternative embodiment, the two adjacent clear layers have a refractive index difference of greater than 0.05, more preferably greater than 0.1, most preferably greater than 0.2. In this embodiment, light passing through the interface of the two clear layers would be greatly refracted, creating novel perception of the inner component and/or dimple effects (shadows) internal to the golf ball.

Refractive indices of some suitable polymers include, but are not limited to, SURLYNS® ~1.55; polyurethanes ~1.6–1.66; polymethylmethacrylates ~1.49; cast acrylics ~1.49–1.515; molded high flow acrylics ~1.49–1.491; acrylonitrile-methyl acrylate copolymers ~1.51; molded/extruded fluorinated ethylene propylenes ~1.34; molded polycarbonates 1.583–1.586; polystyrenes ~1.581–1.583; molded styrene acrylonitriles ~1.57; silicone RTV's ~1.406–1.41; natural rubbers ~1.519; high flow acrylic resins 1.49; polyether block amides ~1.502; polyimides ~1.7; polyethylene resins ~1.51; natural cellulose acetate butyrates ~1.475; natural cellulose acetate propionates ~1.475; silicone encapsulating gels ~1.41; methylpentene copolymers ~1.463; amorphous nylons ~1.58; styrenic acrylic copolymers ~1.57; vinyl alcohol copolymers ~1.518–1.525; polyvinylidene fluorides ~1.42; cyclo olefin polymers ~1.53; and olefin resins ~1.48–1.52.

In one unique embodiment, the outer cover and core layer materials are chosen such that their respective refractive indices are sufficiently different to cause total internal reflection of light, either incident from outside the golf ball or from a fluorescent internal non-spherical insert, at the interface between the two layers. When light passes from a medium with one index of refraction ($m_1$) to another medium with a lower index of refraction ($m_2$), it bends or refracts away from an imaginary line perpendicular to the surface (normal line). As the angle of the beam through $m_1$ becomes greater with respect to the normal line, the refracted light through $m_2$ bends further away from the line. At one particular angle (the critical angle), the refracted light will not go into $m_2$, but instead will travel along the surface between the two media (sin [critical angle]=$n_2/n_1$ where $n_1$ and $n_2$ are the indices of refraction [$n_1$ is less than $n_2$]). If the beam through $m_1$ is greater than the critical angle, then the refracted beam will be reflected entirely back into $m_1$ (total internal reflection), even though $m_2$ may be transparent.

In another embodiment of the present invention, the non-spherical insert can be used as an alignment aid for a golf swing or stroke, such as a putting stroke. The non-spherical insert preferably has a 'rim' attached to the insert, the rim being located along an equator of the golf ball and being seen though the clear outer cover or, alternatively, penetrate the outer dimpled surface to be flush therewith.

Other than in the operating examples, or unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising:

a pre-formed selectively-weighted inner core insert comprised of a hub having a specific gravity of greater than 1.2 and a plurality of outer elements connected to the hub and having a specific gravity of less than 0.9;

an outer core molded about the insert to form a sphere having an outer surface; and a cover disposed around the outer core, the cover having an outer dimpled surface;

wherein the outer core and cover are optically transparent or translucent and wherein the outer core has a first refractive index and the cover has a second refractive index that differs from the first by less than 0.01.

2. The golf ball of claim 1, wherein the hub has a specific gravity of greater than 1.8 and the outer elements have a specific gravity of less than 0.8.

3. The golf ball of claim 1, wherein the outer elements are flush with the outer surface of the core.

4. The golf ball of claim 1, wherein the outer core has a first refractive index and the cover has a second refractive index that differs from the first by at least 0.05.

5. The golf ball of claim 1, wherein the outer elements extend beyond the outer surface of the core and are flush with the outer dimpled surface.

6. The golf ball of claim 1, wherein the outer elements are connected to the hub by corresponding rods.

7. The golf ball of claim 1, wherein the insert comprises a pigment or a dye.

8. The golf ball of claim 7, wherein the dye is a fluorescent dye comprising a thioxanthene, xanthene, perylene, perylene imide, coumarin, thioindigo, naphthalimide, rhodamine, or methine dye.

9. The golf bail of claim 1, wherein at least one of the insert, core layer, or cover layer comprise reflective fillers, fibers, flakes, pigments, dyes, or pearlescents.

10. The golf ball of claim 1, wherein reflective filler comprises metal flakes, iridescent glitters, metallized films, or colored polyester foils.

11. A golf ball comprising:

a pre-formed selectively-weighted inner core insert comprised of a hub having a specific gravity of less than 0.9 and a plurality of outer elements connected to the hub and having a specific gravity of greater than 1.2;

an outer core molded about the insert to form a sphere having an outer surface; and a cover disposed around the outer core, the cover having an outer dimpled surface;

wherein the outer core and cover are optically transparent or translucent and wherein the outer core has a first refractive index and the cover has a second refractive index that differs from the first by at least 0.05.

12. The golf ball of claim 11, wherein the hub has a specific gravity of less than 0.8 and the outer elements have a specific gravity of greater than 1.8.

13. The golf ball of claim 12, wherein the outer elements are flush with the outer surface of the core.

14. The golf ball of claim 11, wherein the outer elements extend beyond the outer surface of the core and are flush with the outer dimpled surface.

15. The golf ball of claim 11, wherein the outer core has a first refractive index and the cover has a second refractive index that differs from the first by less than 0.01.

16. The golf ball of claim 11, wherein the insert comprises a pigment or a dye.

17. The golf ball of claim 11, wherein at least one of the core layer or cover layer comprises reflective fillers, fibers, flakes, pigments, dyes, or pearlescents.

18. A golf ball comprising:

a pre-formed non-spherical inner core insert;

an outer core molded about the insert to form a sphere having an outer surface; and a cover disposed about the outer core, the cover having an outer dimpled surface;

wherein the outer core and cover are optically transparent or translucent and are formed from polymers having a refractive index of between 1.45 and 1.6.

* * * * *